US009928674B2

(12) United States Patent
Imsdahl et al.

(10) Patent No.: US 9,928,674 B2
(45) **Date of Patent: *Mar. 27, 2018**

(54) OPERATING ELECTRONIC LOCK AUTOMATICALLY BASED ON USER PROFILE

(71) Applicant: International Business Machines Corporation, Armonk, NY (US)

(72) Inventors: Marit L. Imsdahl, Cary, NC (US); Alexandra D. Markello, Fayetteville, NC (US); Edna Y. Morales, Raleigh, NC (US); Christopher Sutton, Hertfordshire (GB)

(73) Assignee: INTERNATIONAL BUSINESS MACHINES CORPORATION, Armonk, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/723,386

(22) Filed: Oct. 3, 2017

(65) Prior Publication Data

US 2018/0018842 A1 Jan. 18, 2018

Related U.S. Application Data

(63) Continuation of application No. 14/956,821, filed on Dec. 2, 2015.

(51) Int. Cl.
*G07C 9/00* (2006.01)

(52) U.S. Cl.
CPC ..... *G07C 9/00309* (2013.01); *G07C 9/00817* (2013.01); *G07C 2009/00769* (2013.01)

(58) Field of Classification Search
CPC ..... G07C 9/00309; G07C 9/00817; G07C 2009/00769
See application file for complete search history.

(56) References Cited

U.S. PATENT DOCUMENTS

2016/0036594 A1 2/2016 Conrad et al.
2016/0217631 A1 7/2016 Petricoin, Jr.
2016/0350988 A1 12/2016 Malhotra

*Primary Examiner* — Leon Flores
(74) *Attorney, Agent, or Firm* — Cantor Colburn LLP; David Zwick

(57) ABSTRACT

Examples of techniques for automatically operating an electronic lock based on a user profile of a user are disclosed. In one example implementation according to aspects of the present disclosure, a computer-implemented method may include receiving an indication of the user changing a state of the electronic lock. The method may further include storing information associated with the user changing the state of the electronic lock. The method may further include generating, by a processor, the user profile based on the information associated with the user changing the state of the electronic lock. The method may further include determining, by the processor, that the state of the electronic lock should be changed based on the user profile. The method may further include automatically changing the state of the electronic lock when it is determined to change the state of the electronic lock based on the user profile.

1 Claim, 4 Drawing Sheets

OPERATING ELECTRONIC LOCK AUTOMATICALLY BASED ON USER PROFILE

DOMESTIC PRIORITY

This application is a continuation of U.S. patent application Ser. No. 14/956,821, entitled "OPERATING ELECTRONIC LOCK AUTOMATICALLY BASED ON USER PROFILE," filed Dec. 2, 2015, the disclosure of which is incorporated by reference herein in its entirety.

BACKGROUND

The present disclosure relates to operating an electronic lock and, more particularly, relates to automatically operating an electronic lock based on a user profile.

An individual may carry multiple keys for the various locks with which he interacts. For example, an individual may have a key for his house, his car, his office, his filing cabinet, and the like. Keys can be inconvenient. For example, if an individual is carrying groceries in the house from the car, his hands may be full and unable to easily retrieve his keys from his pocket and operate the lock on the door to the house.

With the addition of electronic locks (e.g., locks that may be operated remotely, such as by a remote control, mobile phone application, or web browser), physical keys may no longer be necessary to operate the lock. However, many of these devices utilize priority remotes or applications to control them. For example, a remote device for an electronic car lock may not operate an electronic house like, and vice versa.

SUMMARY

In accordance with aspects of the present disclosure, a computer-implemented method for automatically operating an electronic lock based on a user profile for a user is provided. The computer-implemented method includes receiving an indication of the user changing a state of the electronic lock. The computer-implemented method further includes storing information associated with the user changing the state of the electronic lock. The computer-implemented method further includes generating, by a processing device, the user profile based on the information associated with the user changing the state of the electronic lock. The computer-implemented method further includes determining, by the processing device, that the state of the electronic lock should be changed based on the user profile. The computer-implemented method further includes automatically changing the state of the electronic lock when it is determined to change the state of the electronic lock based on the user profile.

In accordance with additional aspects of the present disclosure, a system for automatically operating an electronic lock based on a user profile for a user is provided. The system includes a processor in communication with one or more types of memory. The processor is configured to perform the following: receive an indication of the user changing a state of the electronic lock, store information associated with the user changing the state of the electronic lock, generate the user profile based on the information associated with the user changing the state of the electronic lock, determine that the state of the electronic lock should be changed based on the user profile, and automatically change the state of the electronic lock when it is determined to change the state of the electronic lock based on the user profile.

In accordance with yet additional aspects of the present disclosure, a computer program product for automatically operating an electronic lock based on a user profile for a user is provided. The computer program product includes a non-transitory storage medium readable by a processing circuit and storing instructions for execution by the processing circuit for performing a method. The method includes receiving an indication of the user changing a state of the electronic lock. The method further includes storing information associated with the user changing the state of the electronic lock. The method further includes generating, by a processor, the user profile based on the information associated with the user changing the state of the electronic lock. The method further includes determining, by the processor, that the state of the electronic lock should be changed based on the user profile. The method further includes automatically changing the state of the electronic lock when it is determined to change the state of the electronic lock based on the user profile.

BRIEF DESCRIPTION OF THE DRAWINGS

The subject matter which is regarded as the invention is particularly pointed out and distinctly claimed in the claims at the conclusion of the specification. The forgoing and other features, and advantages thereof, are apparent from the following detailed description taken in conjunction with the accompanying drawings in which:

DETAILED DESCRIPTION

Various implementations of techniques for automatically operating an electronic lock based on a user profile are described below by referring to several examples thereof. The techniques described herein enable a processing system to collect and store information associated with a user changing the state of a lock. The information can be used to generate a user profile so that future state changes of the lock may be determined based on the user profile. As the user continues to operate electronic locks, adds new electronic locks, and/or changes his activities in interacting with the electronic locks, the user profile may be altered or updated to reflect changes.

In aspects of the present disclosure, the user can operate an electronic lock using a processing device (e.g., the user's smart phone, laptop, wearable processing device, etc.). In additional aspects, the lock desired to be operated may be acted upon while other locks may not be affected. Moreover, the present disclosure provides for generating a user profile and updating the profile based on the user's operating of electronic locks. These and other advantages will be apparent from the description that follows.

Figure 1:
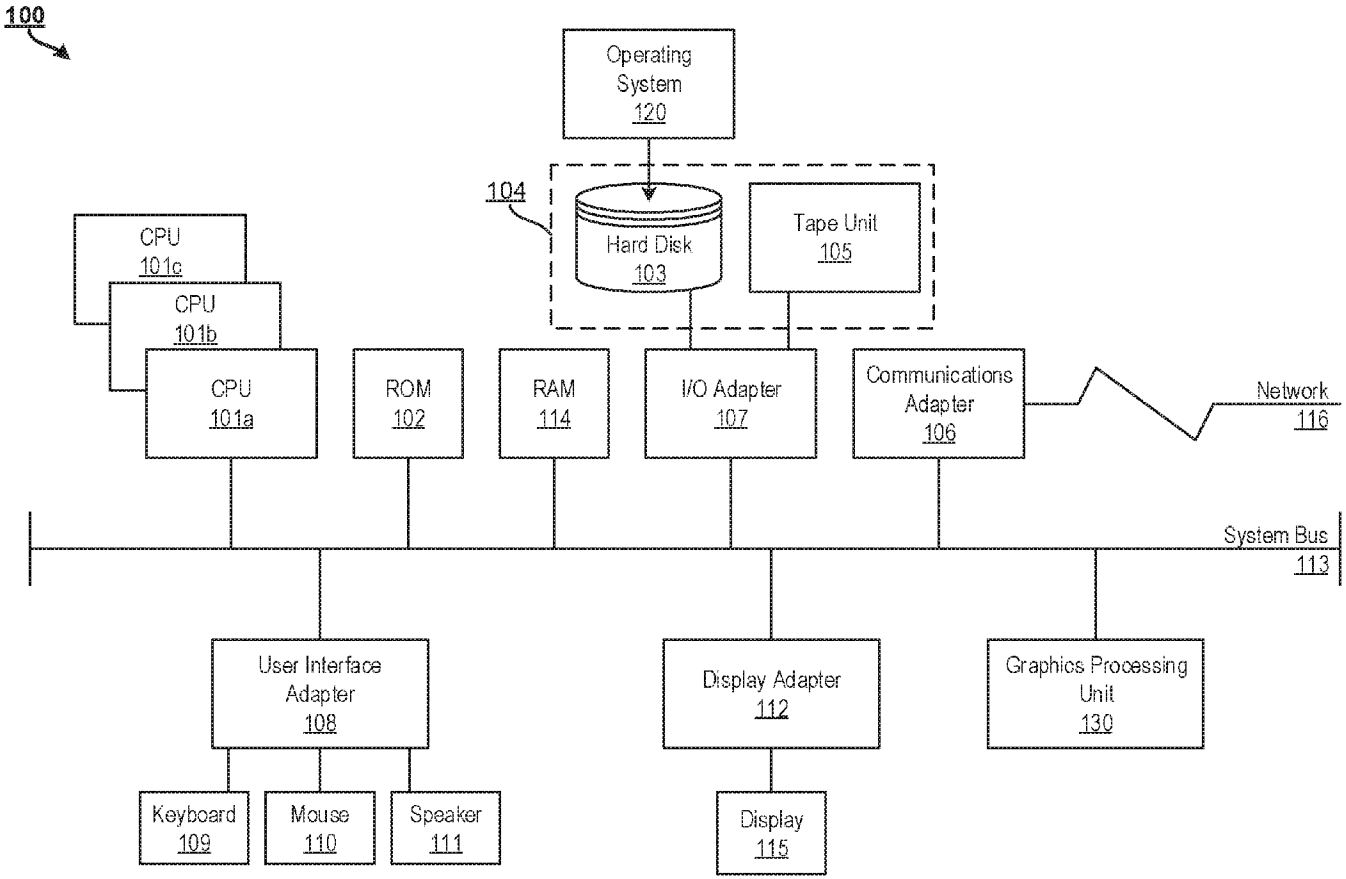
FIG. 1 illustrates a block diagram of a processing system for implementing the techniques described herein according to examples of the present disclosure.

FIG. 1 illustrates a block diagram of a processing system 100 for implementing the techniques described herein. In examples, the processing system 100 has one or more central processing units (processors) 101*a*, 101*b*, 101*c*, etc. (collectively or generically referred to as processor(s) 101). In aspects of the present disclosure, each processor 101 may include a reduced instruction set computer (RISC) microprocessor. Processors 101 are coupled to system memory (e.g., random access memory (RAM) 114 and various other components via a system bus 113. Read only memory (ROM) 102 is coupled to the system bus 113 and may include a basic input/output system (BIOS), which controls certain basic functions of the processing system 100.

FIG. 1 further illustrates an input/output (I/O) adapter 107 and a communications adapter 106 coupled to the system bus 113. I/O adapter 107 may be a small computer system interface (SCSI) adapter that communicates with a hard disk 103 and/or tape storage drive 105 or any other similar component. I/O adapter 107, hard disk 103, and tape storage device 105 are collectively referred to herein as mass storage 104. Operating system 120 for execution on the processing system 100 may be stored in mass storage 104. A network adapter 106 interconnects bus 113 with an outside network 116 enabling the processing system 100 to communicate with other such systems.

A screen (e.g., a display monitor) 115 is connected to system bus 113 by display adaptor 112, which may include a graphics adapter to improve the performance of graphics intensive applications and a video controller. In one aspect of the present disclosure, adapters 106, 107, and 112 may be connected to one or more I/O busses that are connected to system bus 113 via an intermediate bus bridge (not shown). Suitable I/O buses for connecting peripheral devices such as hard disk controllers, network adapters, and graphics adapters typically include common protocols, such as the Peripheral Component Interconnect (PCI). Additional input/output devices are shown as connected to system bus 113 via user interface adapter 108 and display adapter 112. A keyboard 109, mouse 110, and speaker 111 all interconnected to bus 113 via user interface adapter 108, which may include, for example, a Super I/O chip integrating multiple device adapters into a single integrated circuit.

In some aspects of the present disclosure, the processing system 100 includes a graphics processing unit 130. Graphics processing unit 130 is a specialized electronic circuit designed to manipulate and alter memory to accelerate the creation of images in a frame buffer intended for output to a display. In general, graphics processing unit 130 is very efficient at manipulating computer graphics and image processing, and has a highly parallel structure that makes it more effective than general-purpose CPUs for algorithms where processing of large blocks of data is done in parallel.

Thus, as configured in FIG. 1, the processing system 100 includes processing capability in the form of processors 101, storage capability including system memory 114 and mass storage 104, input means such as keyboard 109 and mouse 110, and output capability including speaker 111 and display 115. In some aspects of the present disclosure, a portion of system memory 114 and mass storage 104 collectively store an operating system such as the AIX® operating system from IBM Corporation to coordinate the functions of the various components shown in FIG. 1.

Figure 2:
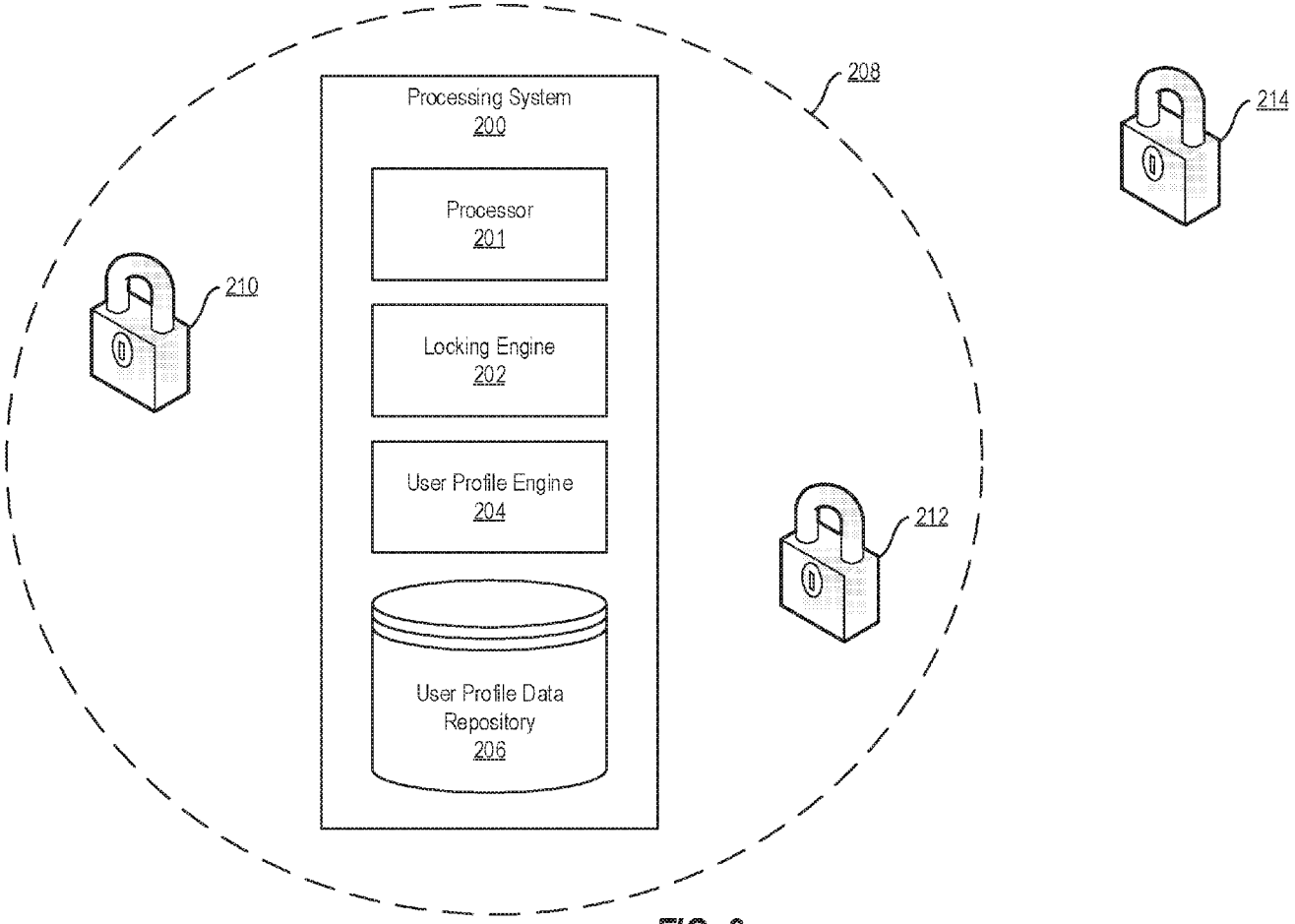
FIG. 2 illustrates a block diagram of a processing system for automatically operating electronic locks based on a user profile according to examples of the present disclosure.

FIG. 2 illustrates a block diagram of a processing system 200 for operating electronics lock 210-214 based on a user profile according to examples of the present disclosure. The various components, modules, engines, etc. described regarding FIG. 2 may be implemented as instructions stored on a computer-readable storage medium, as hardware modules, as special-purpose hardware (e.g., application specific hardware, application specific integrated circuits (ASICs), as embedded controllers, hardwired circuitry, etc.), or as some combination or combinations of these. In examples, the engine(s) described herein may be a combination of hardware and programming. The programming may be processor executable instructions stored on a tangible memory, and the hardware may include processors 101 for executing those instructions. Thus system memory 114 of FIG. 1 can be said to store program instructions that when executed by the processor 201 implements the engines described herein. Other engines may also be utilized to include other features and functionality described in other examples herein.

Processing system 200 may represent a user's mobile device such as a cellular/mobile telephone, a smart phone, a tablet computing device, a wearable computing device, and any other appropriate computing device. In the example of FIG. 2, the processing system 200 comprises a processor 201, a locking engine 202, a user profile engine 204, and a user profile data repository 206. Alternatively or additionally, the processing system 200 may include dedicated hardware, such as one or more integrated circuits, Application Specific Integrated Circuits (ASICs), Application Specific Special Processors (ASSPs), Field Programmable Gate Arrays (FPGAs), or any combination of the foregoing examples of dedicated hardware, for performing the techniques described herein.

Locking engine 202 enables changing the state of electronic locks 210-214 (e.g., to lock an unlocked lock or to unlock a locked lock). In aspects of the present disclosure, a user may initiate a change in state of electronic locks 210-214 such as by causing an application to run on processing system 200. The user may select, such as on an interface of the application, a particular lock from electronic locks 210-214 to change states. For example, if the user wants to change the state of electronic lock 212 from locked to unlocked, the user may select electronic lock 212 on the interface of the application and may then select to change the state to unlocked. In examples, the user may change the state of the lock when the processing system 200 is within a proximity 208 of the electronic lock. In the example of FIG. 2, the processing system 200 is within proximity 208 of electronic locks 210 and 212 but is not within proximity 208 of electronic lock 214. In other examples, the processing system 200 need not be within proximity 208 to operate an electronic lock.

Locking engine 202 may communicate with the electronic locks 210-214 using a variety of wireless communication techniques such as Bluetooth, radio frequency, infrared, cellular, WiFi, and the like or combinations thereof. Electronic locks 210-214 may be integrated into vehicles; doors to homes, offices, or other structures; file cabinets, mail boxes; and any other device or structure desired to be locked.

User profile engine 204 recognizes the change of state of electronic locks 210-214 and stores information associated with the user changing the state of electronic locks 210-214 in user profile data repository 206. The information may include a timestamp of the change in state. For example, the user profile engine 204 may store a date and time when an electronic lock changes state. The information may also include a location of the processing system 200 and a location of the electronic lock. The information may also include a user motion, which may be a physical movement associated with changing the state of the electronic lock. For example, if an electronic lock is in the user's vehicle, the user approaching the vehicle may be considered a user motion and the user leaving the vehicle may be considered another user motion. The information may also include a user action, which may be a user behavior or action the user makes relating to changing the state of a lock.

User profile engine 204 may update the user profile based on additional information associated with the user changing the state of the electronic lock. For example, as the user interacts with different electronic locks or changes his schedule or actions with respect to existing electronic locks, user profile engine 204 may update the user profile to reflect those changes. In examples, user profile engine 204 stores the user profile in user profile data repository 206, which may be any suitable data base, data structure, file system, or other repository for storing data such as the information associated with the user charging the state of the lock, information about electronic locks, and/or user profiles.

Locking engine 202 may utilize the user profile in making decisions as to whether to change the state of an electronic lock. For example, locking engine 202 may determine whether to change the state of the electronic lock based on the user profile. When it is determined to change the state of the electronic lock based on the user profile, locking engine 202 may automatically change the state of the electronic lock.

Figure 3:
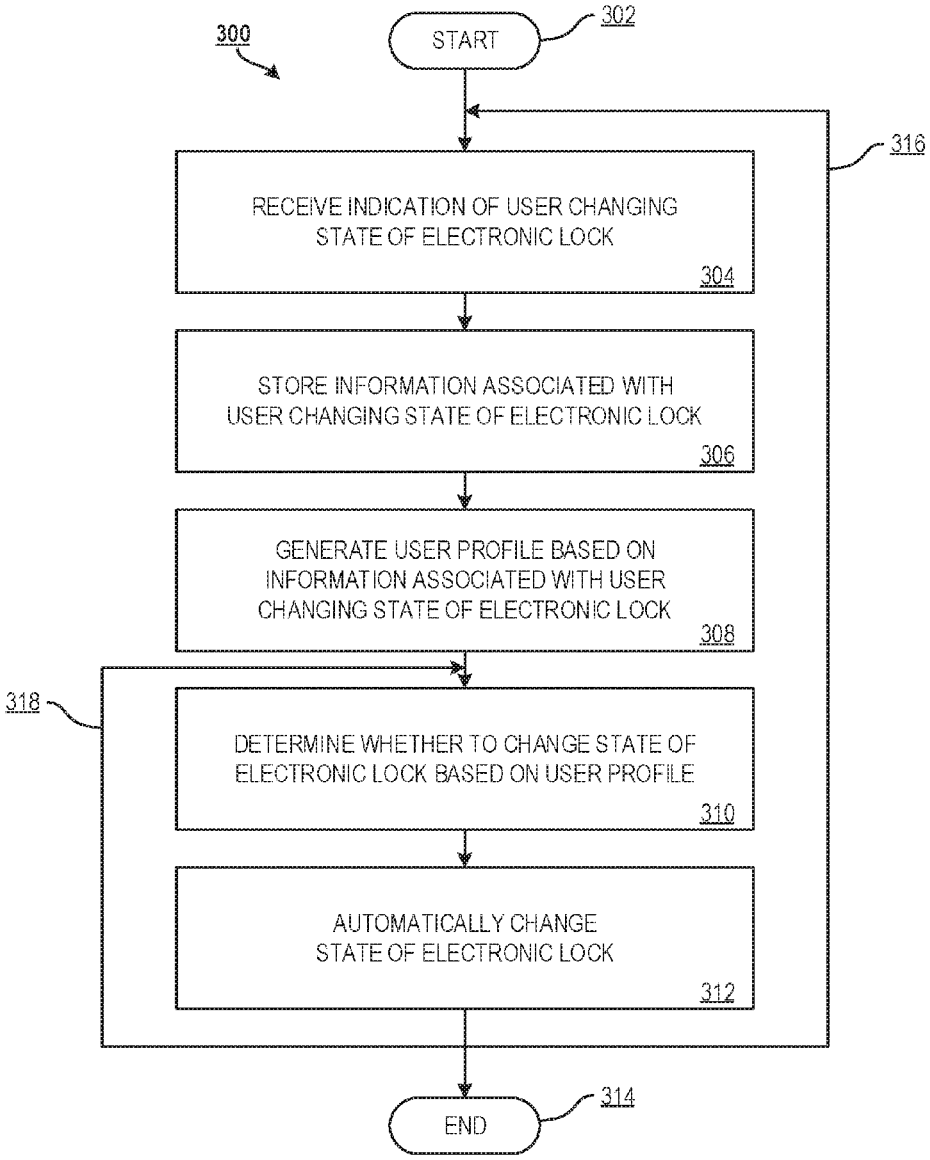
FIG. 3 illustrates a flow diagram of a method for automatically operating an electronic lock based on a user profile according to examples of the present disclosure.

FIG. 3 illustrates a flow diagram of a method 300 for operating an electronic lock based on a user profile according to examples of the present disclosure. The method 300 begins at block 302 and continues to block 304.

At block 304, the method 300 includes receiving an indication of a user changing a state of the electronic lock. In aspects of the present disclosure, the method 300 may include enabling the user to perform a manual verification before automatically changing the state of the electronic lock.

At block 306, the method 300 includes storing information associated with the user changing the state of the electronic lock. In examples, the information associated with the user changing the state of the electronic lock may include a timestamp, a location, a user motion, and a user action.

At block 308, the method 300 includes generating, by a processor, the user profile based on the information associated with the user changing the state of the electronic lock. In additional aspects of the present disclosure, generating the user profile may be based, instead or in addition to, on lock data received from a sensor associated with the electronic lock. For example, if a user attempts to pull a door handle on a vehicle with an electronic lock in the locked state, a sensor associated with an electronic lock of the vehicle may transmit a signal indicating that it is a target to be unlocked. This information may aid in determining which of a plurality of electronic locks located within proximity to each other to unlock.

At block 310, the method 300 includes determining, by the processor, that the state of the electronic lock should be changed based on the user profile.

At block 312, the method 300 includes automatically changing the state of the electronic lock when it is determined to change the state of the electronic lock based on the user profile. However, in aspects of the present disclosure, the method 300 may include enabling the state of the electronic lock to remain unchanged when it is determined to not change the state of the electronic lock based on the user profile. In aspects of the present disclosure, automatically changing the state of the electronic lock based on the user profile may occur without user interaction. Automatically changing the state of the electronic lock may include automatically changing the lock from a locked state to an unlocked state or automatically changing the lock from an unlocked state to a locked state.

The method 300 continues to block 314 and terminates. However, in examples, the method 300 may be iterative, as shown by arrow 316, such that the method continues to receive indications of users changing the states of electronic locks (the same lock and/or additional locks), storing information associated with the changing of state of the electronic locks, generating the user profile based on the information associated with the changing of the electronic locks, determining that the state of the electronic lock should be changed based on the user profile, and automatically changing the state of electronic locks. In this example, the generating of the user profile may include revising an existing user profile, such as if a user's schedule and/or behavior changes. For example, if a user begins leaving earlier for work, the user profile may recognize this change and begin automatically unlocking his car earlier. In addition, the method 300 may be iterative, as shown by arrow 318, such that the method uses the user profile to continue determining whether to change the state of an electronic lock based on the profile and to automatically change the state of the electronic lock when it is determined to do so. In this case, the method 300 may iterate through the determining and changing aspects without generating a new user profile. An existing profile may be used.

Additional processes also may be included, and it should be understood that the processes depicted in FIG. 3 represent illustrations, and that other processes may be added or existing processes may be removed, modified, or rearranged without departing from the scope and spirit of the present disclosure.

Figure 4:
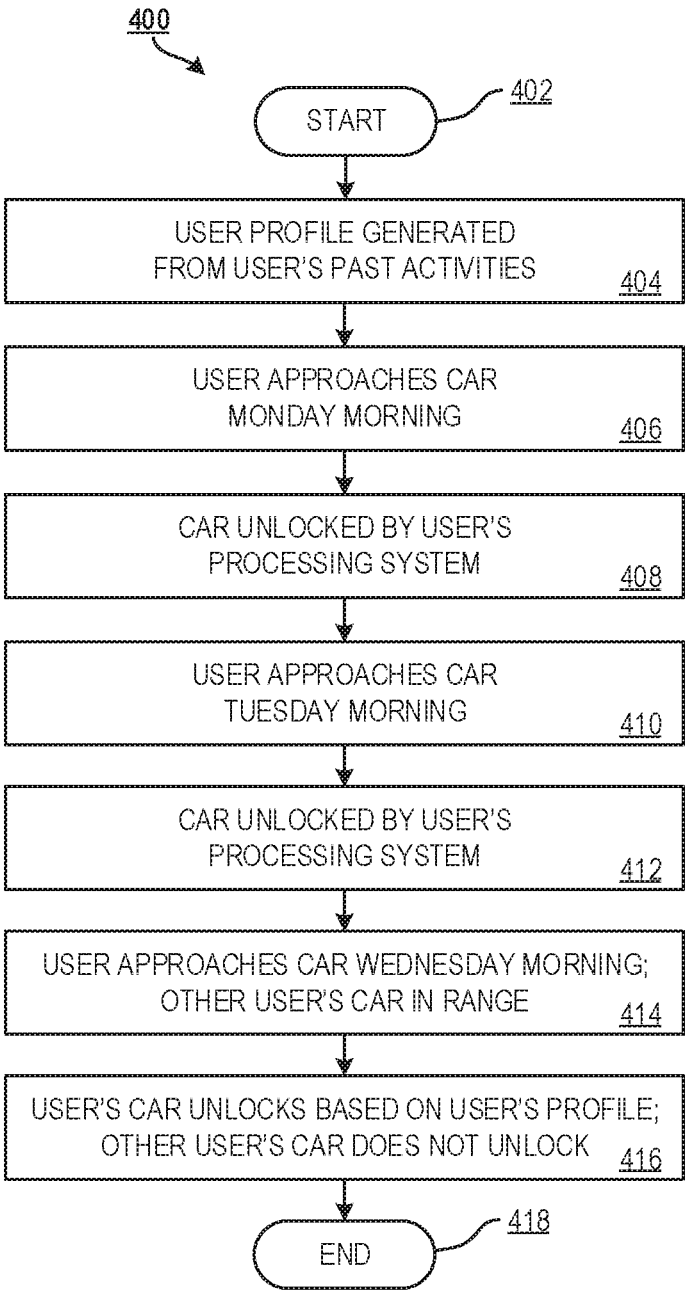
FIG. 4 illustrates a flow diagram of a method for automatically operating an electronic lock based on a user profile according to examples of the present disclosure.

FIG. 4 illustrates a flow diagram of a method 400 for operating an electronic lock based on a user profile according to examples of the present disclosure. The method 400 begins at block 402 and continues to block 404.

At block 404, the method 400 includes a user profile being generated based on a user's past activities. For example, the user profile may utilize data (e.g., a timestamp, a location, a user activity, etc.) associated with the user changing the state of various locks to generate the user profile.

At block 406, the method 400 includes the user approaching his car on Monday morning. At block 408, the car is unlocked by the user's processing system based on the user profile. For example, the user's profile may have previously determined that the user unlocks his car at approximately the same time each weekday morning. Thus, when the user approaches his car Monday morning, the user profile knows to cause the user's processing system to unlock the user's car. Sometime thereafter, the user may lock his car.

At block 410, the method 400 includes the user approaching his car on Tuesday morning. At block 412, the car is again unlocked by the user's processing system based on the user profile. The user may lock his car sometime thereafter.

At block 414, the method 400 includes the user approaching his car on Wednesday morning. However, the user's processing system also senses that his wife's car is in range (for example, his wife's car may be parked next to his in the driveway on Wednesday morning). Although the user's processing system may be configured to unlock his wife's car, the user's user profile determines indicates that the user unlocks his car (not his wife's car) at approximately the same time each weekday morning. Thus, at block 416, when the user approaches his car Wednesday morning, the user profile knows to cause the user's processing system to unlock the user's car and not his wife's car. His wife's car will remain in the state in which it was (e.g., if it was locked, it will remain locked; if it was unlocked, it will remain unlocked). In examples, if the user wants to drive his wife's car on Wednesday, he may use his processing system to manually unlock her car. The method 400 continues to block 418 and terminates.

Additional processes also may be included, and it should be understood that the processes depicted in FIG. 4 represent illustrations, and that other processes may be added or existing processes may be removed, modified, or rearranged without departing from the scope and spirit of the present disclosure.

The present techniques may be implemented as a system, a method, and/or a computer program product. The computer program product may include a computer readable storage medium (or media) having computer readable program instructions thereon for causing a processor to carry out aspects of the present disclosure.

The computer readable storage medium can be a tangible device that can retain and store instructions for use by an instruction execution device. The computer readable storage medium may be, for example, but is not limited to, an electronic storage device, a magnetic storage device, an optical storage device, an electromagnetic storage device, a semiconductor storage device, or any suitable combination of the foregoing. A non-exhaustive list of more specific examples of the computer readable storage medium includes the following: a portable computer diskette, a hard disk, a random access memory (RAM), a read-only memory (ROM), an erasable programmable read-only memory (EPROM or Flash memory), a static random access memory (SRAM), a portable compact disc read-only memory (CD-ROM), a digital versatile disk (DVD), a memory stick, a floppy disk, a mechanically encoded device such as punch-cards or raised structures in a groove having instructions recorded thereon, and any suitable combination of the foregoing. A computer readable storage medium, as used herein, is not to be construed as being transitory signals per se, such as radio waves or other freely propagating electromagnetic waves, electromagnetic waves propagating through a waveguide or other transmission media (e.g., light pulses passing through a fiber-optic cable), or electrical signals transmitted through a wire.

Computer readable program instructions described herein can be downloaded to respective computing/processing devices from a computer readable storage medium or to an external computer or external storage device via a network, for example, the Internet, a local area network, a wide area network and/or a wireless network. The network may comprise copper transmission cables, optical transmission fibers, wireless transmission, routers, firewalls, switches, gateway computers and/or edge servers. A network adapter card or network interface in each computing/processing device receives computer readable program instructions from the network and forwards the computer readable program instructions for storage in a computer readable storage medium within the respective computing/processing device.

Computer readable program instructions for carrying out operations of the present disclosure may be assembler instructions, instruction-set-architecture (ISA) instructions, machine instructions, machine dependent instructions, microcode, firmware instructions, state-setting data, or either source code or object code written in any combination of one or more programming languages, including an object oriented programming language such as Smalltalk, C++ or the like, and conventional procedural programming languages, such as the "C" programming language or similar programming languages. The computer readable program instructions may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider). In some examples, electronic circuitry including, for example, programmable logic circuitry, field-programmable gate arrays (FPGA), or programmable logic arrays (PLA) may execute the computer readable program instructions by utilizing state information of the computer readable program instructions to personalize the electronic circuitry, in order to perform aspects of the present disclosure.

Aspects of the present disclosure are described herein with reference to flowchart illustrations and/or block diagrams of methods, apparatus (systems), and computer program products according to aspects of the present disclosure. It will be understood that each block of the flowchart illustrations and/or block diagrams, and combinations of blocks in the flowchart illustrations and/or block diagrams, can be implemented by computer readable program instructions.

These computer readable program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks. These computer readable program instructions may also be stored in a computer readable storage medium that can direct a computer, a programmable data processing apparatus, and/or other devices to function in a particular manner, such that the computer readable storage medium having instructions stored therein comprises an article of manufacture including instructions which implement aspects of the function/act specified in the flowchart and/or block diagram block or blocks.

The computer readable program instructions may also be loaded onto a computer, other programmable data processing apparatus, or other device to cause a series of operational steps to be performed on the computer, other programmable apparatus or other device to produce a computer implemented process, such that the instructions which execute on the computer, other programmable apparatus, or other device implement the functions/acts specified in the flowchart and/or block diagram block or blocks.

The flowchart and block diagrams in the Figures illustrate the architecture, functionality, and operation of possible implementations of systems, methods, and computer program products according to various aspects of the present disclosure. In this regard, each block in the flowchart or block diagrams may represent a module, segment, or portion of instructions, which comprises one or more executable instructions for implementing the specified logical function (s). In some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts or carry out combinations of special purpose hardware and computer instructions.

What is claimed is:

1. A computer-implemented method for automatically operating an electronic lock based on a user profile for a user, the method comprising:

receiving an indication of the user changing a state of the electronic lock;

storing information associated with the user changing the state of the electronic lock;

receiving, by a user processing device, sensor data from a sensor associated with the electronic lock, wherein the sensor data comprises at least a signal indicating that the electronic lock is a target electronic lock;

generating, by the user processing device, the user profile based at least in part on the information associated with the user changing the state of the electronic lock and based at least in part on the sensor data received from the sensor associated with the electronic lock;

determining, by the user processing device, that the state of the electronic lock should be changed based on the user profile; and automatically changing the state of the electronic lock when it is determined to change the state of the electronic lock based on the user profile, and when it is determined that the electronic lock is the target electronic lock, wherein the target electronic lock is one of a plurality of electronic locks within a proximity of the processing device, wherein a state of the other of the plurality of electronic locks within a proximity of the processing device that are not the target electronic lock remain unchanged, wherein receiving the indication of the user changing the state of the lock further comprises enabling the user to perform a manual verification before automatically changing the state of the electronic lock, and wherein determining that the state of the electronic lock should be changed is further based on the sensor data received from the sensor associated with the electronic lock.

* * * * *